US007777769B2

(12) United States Patent
Nozawa

(10) Patent No.: US 7,777,769 B2
(45) Date of Patent: Aug. 17, 2010

(54) IMAGE FORMING UNIT AND IMAGE FORMING APPARATUS

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 348 days.

(21) Appl. No.: 11/513,135

(22) Filed: Aug. 31, 2006

(65) Prior Publication Data

US 2007/0064082 A1 Mar. 22, 2007

(30) Foreign Application Priority Data

Sep. 12, 2005 (JP) ..... 2005-263478

(51) Int. Cl.

| | |
|---|---|
| ***B41J 2/385*** | (2006.01) |
| ***B41J 2/39*** | (2006.01) |
| ***B41J 2/00*** | (2006.01) |
| ***B41J 2/41*** | (2006.01) |
| ***B41J 2/45*** | (2006.01) |
| ***B41J 2/435*** | (2006.01) |
| ***B41J 27/00*** | (2006.01) |

(52) U.S. Cl. ..... 347/149; 347/130; 347/138; 347/141; 347/152; 347/238; 347/245; 347/257; 347/263

(58) Field of Classification Search ..... 399/159
See application file for complete search history.

(56) References Cited

U.S. PATENT DOCUMENTS

| | | | | |
|---|---|---|---|---|
| 4,703,334 | A | 10/1987 | Mochimaru et al. | |
| 6,801,232 | B2 * | 10/2004 | Nagamine et al. | 347/149 |
| 2004/0008333 | A1 * | 1/2004 | Oda et al. | 355/55 |

FOREIGN PATENT DOCUMENTS

| | | | |
|---|---|---|---|
| JP | 2001142368 A | * | 5/2001 |
| JP | 2002-361931 | | 12/2002 |
| JP | 2006018126 A | * | 1/2006 |

* cited by examiner

*Primary Examiner*—Matthew Luu
*Assistant Examiner*—Kendrick X Liu
(74) *Attorney, Agent, or Firm*—Rabin & Berdo, P.C.

(57) ABSTRACT

An image forming unit is provided in which, through making a distance limiting member to limit a distance between an exposing unit and an image carrying body be able to contact and separate with respect to the image carrying body by a contact/separation enabling section, it is eliminated that developer remaining on the surface of the image carrying body coagulates on the distance limiting member, so it is eliminated that the surface of the image carrying body is scraped by the developer, and that a bad print occurs. The image forming unit has an image carrying body exposed by an exposing unit, a distance limiting member to limit a distance between the exposing unit and the image carrying body. The distance limiting member is installed capable of contacting with and separating from the image carrying body by a contact/separation enabling section.

14 Claims, 22 Drawing Sheets

*PRIOR ART*

IMAGE FORMING UNIT AND IMAGE FORMING APPARATUS

BACKGROUND OF THE INVENTION

1. Field of the Invention

The invention relates to an image forming unit and an image forming apparatus.

2. Related Background Art

Conventionally, in an image forming unit of an image forming apparatus such as printer with electrophotography and the like, there is a distance limiting member for limiting a distance between a LED (Light Emitting Diode) head as an exposing unit and a photosensitive drum as an image carrying body. Such technology is disclosed by patent document 1.

FIG. 2 is a squint-eyed diagram showing an image forming unit of a conventional image forming apparatus.

As shown by FIG. 2, an image forming unit has a photosensitive drum 102 and a LED head 101 for performing an exposure on the photosensitive drum 102. Then, between the surface of the photosensitive drum 102 and the LED head 101, at least one spacer 103 is furnished. The spacer 103 limits a distance between the surface of the photosensitive drum 102 and the LED head 101.

Patent document 1: Japan patent publication 2002-361931.

However, in the image forming unit of a conventional image forming apparatus, because of toner 105 adhering to the spacer 103, the surface of the photosensitive drum 102 is scraped off, and a bad print is caused. That is, in the case that the toner 105 is remaining on the surface of the photosensitive drum 102, when the photosensitive drum 102, as shown by the drawing, rotates along a direction indicated by an arrow A, on an upstream side end portion 104 in the spacer 103 in a rotation direction of the photosensitive drum 102, the toner 105 accumulates and adheres.

Further, heat occurs through a friction between the toner 105 and the surface of the photosensitive drum 102. Then the toner 105 liquefies due to the heat. The toner 105 having liquefied, after the rotation of the photosensitive drum 102 ended, is cooled to coagulate on the upstream side end portion of the spacer 103.

Then, when the photosensitive drum 102 rotates, the toner 105 having coagulated on the upstream side end portion 104 of the spacer 103 scrapes the surface of the photosensitive drum 102, and a bad print occurred.

SUMMARY OF THE INVENTION

It is, therefore, an object of the invention to provide an image forming unit in an image forming apparatus capable of solving the above problem. In the image forming unit, through making a distance limiting member to limit a distance between an exposing unit and an image carrying body be able to contact and separate with respect to the image carrying body by a contact/separation enabling section, it is eliminated that developer remaining on the surface of the image carrying body coagulates on the distance limiting member. Therefore, it is eliminated that the surface of the image carrying body is scraped by the developer, and it is eliminated that a bad print occurs.

According to the present invention, there is provided an image forming unit, comprising:

an image carrying body exposed by an exposing unit; and a distance limiting member to limit a distance between the exposing unit and the image carrying body, wherein the distance limiting member is installed so as to be capable of contacting with and separating from the image carrying body by a contact/separation enabling section.

Moreover, in the image forming unit, the contact/separation enabling section, after made the distance limiting member leave from the image carrying body, may again make the distance limiting member contact with the image carrying body in a position which has made the surface of the image carrying body at least more move than a length of a contact area of the distance limiting member.

Further, according to the present invention, there is also provided an image forming unit, comprising:

an image carrying body exposed by an exposing unit;

a distance limiting member to limit a distance between the exposing unit and the image carrying body; and a cleaning member which is placed at an upstream side of the distance limiting member in a rotation direction of the image carrying body and has a width corresponding to the distance limiting member.

Moreover, in the image forming unit according the cleaning member may be formed in one body with the distance limiting member.

Moreover, in the image forming unit, the cleaning member may be formed as being inclined with respect to a width direction for cleaning. In the case, an inclination of the cleaning member may be formed toward the inside of the image carrying body. Then, the inside may be a center portion of the image carrying body in a length direction.

Furthermore, according to the present invention, there is also provided an image forming unit, comprising:

an image carrying body exposed by an exposing unit; and a distance limiting member to limit a distance between the exposing unit and the image carrying body, wherein the distance limiting member has an image carrying body rotation direction upstream side end portion with an inclination with respect to a rotation direction of the image carrying body.

Moreover, in the image forming unit, the inclination of the cleaning member may be formed toward the inside of the image carrying body. Then, the inside is a center portion of the image carrying body in a length direction.

Moreover, in the image forming unit, the distance limiting member may have an image carrying body rotation direction downstream side end portion with an inclination with respect to a rotation direction of the image carrying body.

Further, according to the present invention, there is provided an image forming apparatus comprising an image forming unit, wherein the image forming unit has an image carrying body exposed by an exposing unit; and a distance limiting member to limit a distance between the exposing unit and the image carrying body, wherein the distance limiting member is installed capable of contacting with and separating from the image carrying body by a contact/separation enabling section.

Moreover, in the image forming apparatus, the contact/separation enabling section, after made the distance limiting member leave from the image carrying body, may again make the distance limiting member contact with the image carrying body in a position which has made the surface of the image carrying body at least more move than a length of a contact area of the distance limiting member.

Furthermore, according to the present invention, there is also provided an image forming apparatus comprising an image forming unit, wherein the image forming unit has an image carrying body exposed by an exposing unit; a distance limiting member to limit a distance between the exposing unit and the image carrying body; and a cleaning member which is placed at an upstream side of the distance limiting member in a rotation direction of the image carrying body and has a width corresponding to the distance limiting member.

Moreover, in the image forming apparatus according the cleaning member may be formed in one body with the distance limiting member.

Moreover, in the image forming apparatus, the cleaning member may be formed as being inclined with respect to a width direction for cleaning. In the case, an inclination of the cleaning member may be formed toward the inside of the image carrying body. Then, the inside may be a center portion of the image carrying body in a length direction.

Furthermore, according to the present invention, there is also provided an image forming apparatus comprising an image forming unit, wherein the image forming unit has an image carrying body exposed by an exposing unit; and a distance limiting member to limit a distance between the exposing unit and the image carrying body, wherein the distance limiting member has an image carrying body rotation direction upstream side end portion with an inclination with respect to a rotation direction of the image carrying body.

Moreover, in the image forming apparatus, the inclination of the cleaning member may be formed toward the inside of the image carrying body. Then, the inside is a center portion of the image carrying body in a length direction.

Moreover, in the image forming apparatus, the distance limiting member may have an image carrying body rotation direction downstream side end portion with an inclination with respect to a rotation direction of the image carrying body.

According to the present invention, it is eliminated that developer remaining on the surface of the image carrying body coagulates on the distance limiting member; it is eliminated that the surface of the image carrying body is scraped by the developer; and it is eliminated that a bad print occurs.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Figure 3:
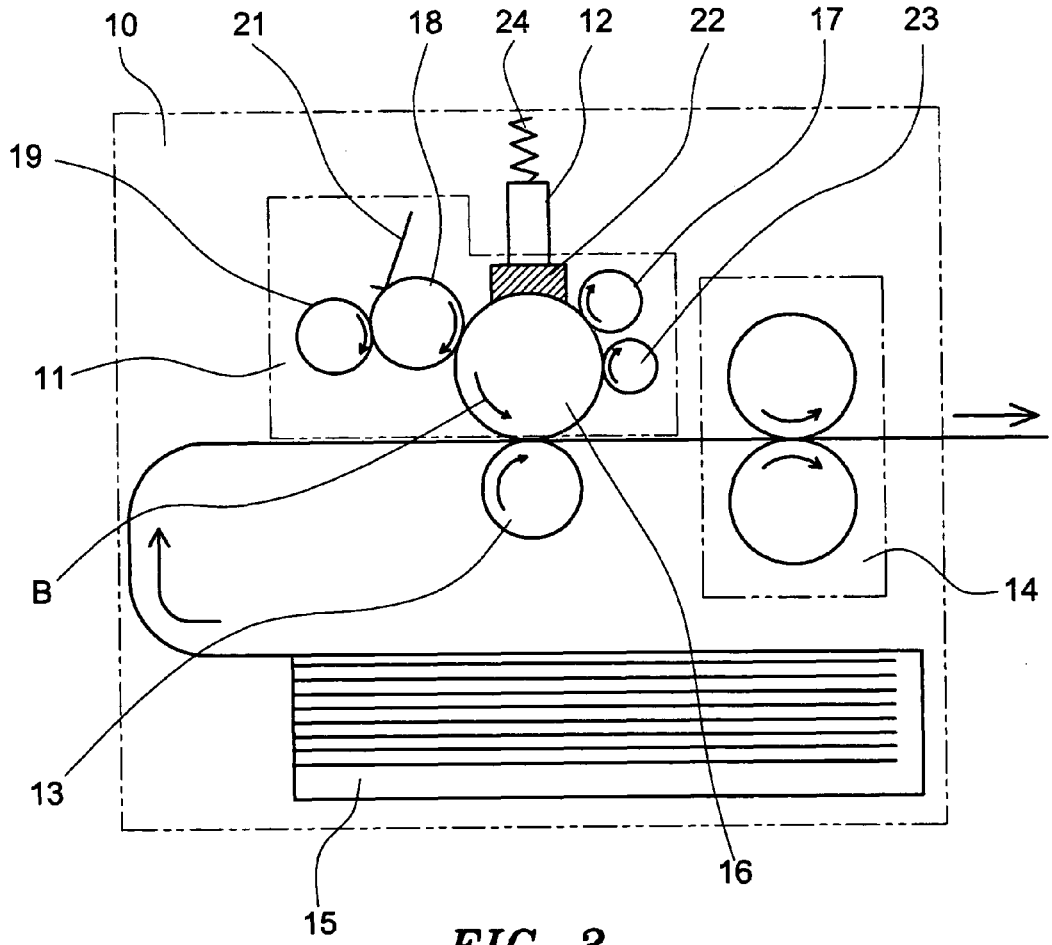
FIG. 3 is a summary diagram showing a structure of an image forming apparatus in embodiment 1 of the present invention.

FIG. 3 is a summary diagram showing a structure of an image forming apparatus in embodiment 1 of the present invention.

In the FIG. 3, 10 is an electrophotography printer as an image forming apparatus in the embodiment. Moreover, as the image forming apparatus, it may be a facsimile apparatus with electrophotography, a copying apparatus, a multiple apparatus including facsimile function and copy function or the like. Here is to explain an electrophotography printer.

The electrophotography printer 10 has an image drum cartridge (hereinafter: it is called ID) 11 as an image forming unit; a LED head 12 as an exposing unit; a transferring unit 13 to transfer an toner image onto a medium such as print sheet or the like; a fixing unit 14 to fixing the toner image transferred on the medium; and a sheet supplying unit 15 to accommodate the medium and to supply it.

Then, the ID 11 has a photosensitive drum 16 as an image carrying body which is constructed from an electroconductive basic layer made from Aluminum and an external layer made from an organic photosensitive body; a charging roller 17 obtained through forming a semiconductive rubber such as epichlorohydrin rubber and the like onto a metal shaft with electroconductivity in a roll shape; a developing roller 18 obtained through forming a semiconductive rubber such as silicon an the like onto a metal shaft with electroconductivity; a providing roller 19 obtained through doping a foaming agent into a rubber in a mixed manufacture in order to improve conveyance ability of developer i.e. toner and forming the a rubber onto a metal shaft with electroconductivity; a developing blade 21 for uniformly forming a thin layer of toner on the developing roller 18; a spacer 22 as a distance limiting member to limit a distance between the LED head 12 and the photosensitive drum 16; and a cleaning roller 23 for shaving a stated below transfer remainder toner 25 remaining on the photosensitive drum 16 after the transferring unit 13 transferred a toner image onto the medium.

Moreover, the charging roller 17, the developing roller 18, the spacer 22 and the cleaning roller 23 are furnished as contacting with the surface of the photosensitive drum 16. Further, the developing blade 21 an the providing roller 19 are furnished as contacting with the surface of the developing roller 18. Then, a developing roller power supply, a providing roller supply, a developing blade power supply, a charging unit power supply and a cleaning roller power supply that are not shown respectively connected with the developing roller 18, the providing roller 19, the developing blade 21, the charging roller 17 and the cleaning roller 23 so as to possibly supply bias.

Furthermore, in the spacer 22, one end contacts with the LED head 12 which is pressed toward the photosensitive drum 16 by a LED head pressing member 24, and other end contacts with the surface of the photosensitive drum 16.

Next is to explain a furnishing structure of the spacer 22.

Figure 1:
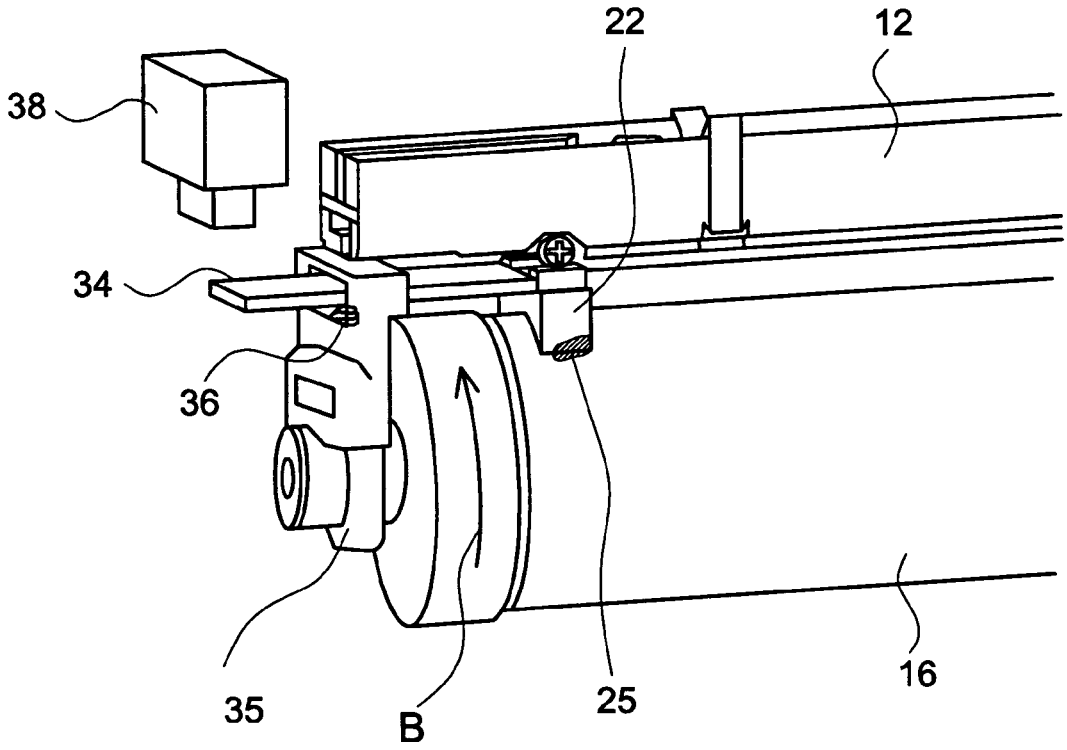
FIG. 1 is a squint-eyed diagram showing a spacer furnished in between a LED head and a photosensitive drum in embodiment 1 of the present invention.
Figure 2:
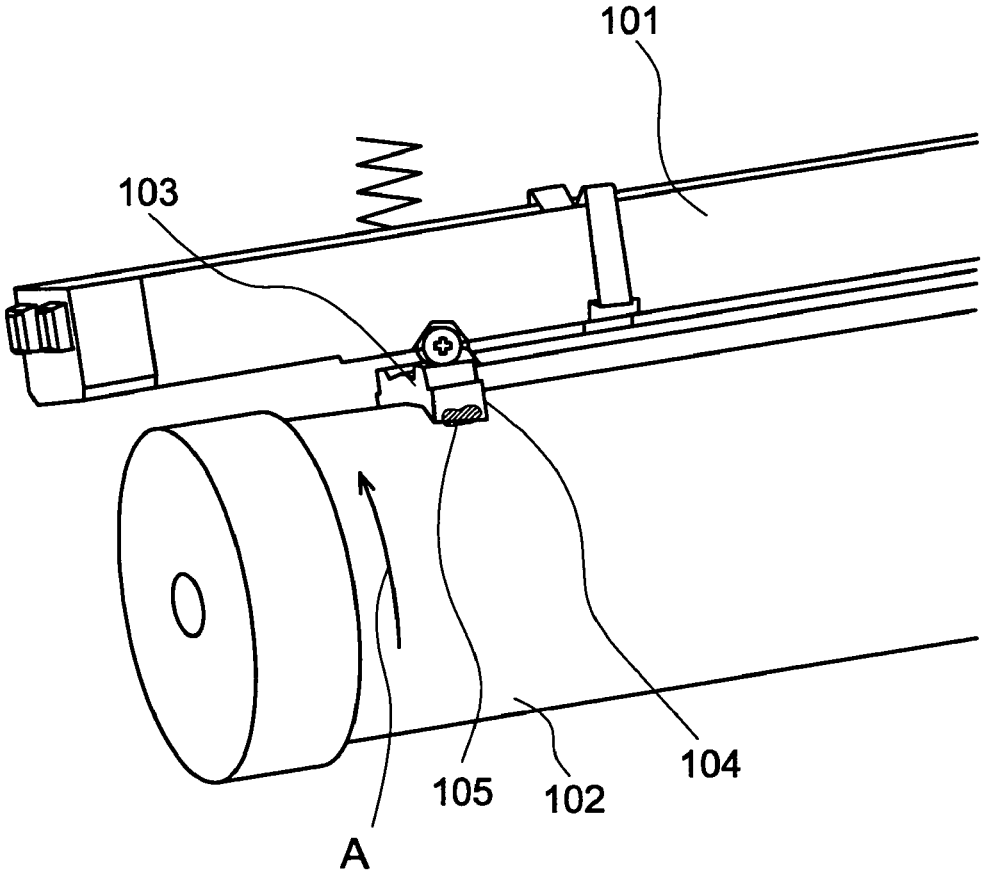
FIG. 2 is a squint-eyed diagram showing an image forming unit of a conventional image forming apparatus.
Figure 4:
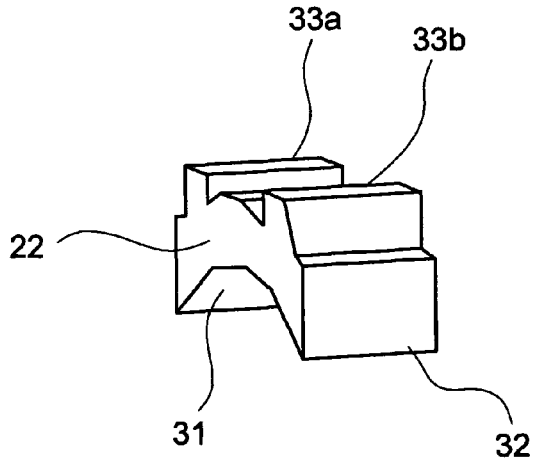
FIG. 4 is a squint-eyed diagram showing a summary shape of a spacer in embodiment 1 of the present invention.
Figure 5:
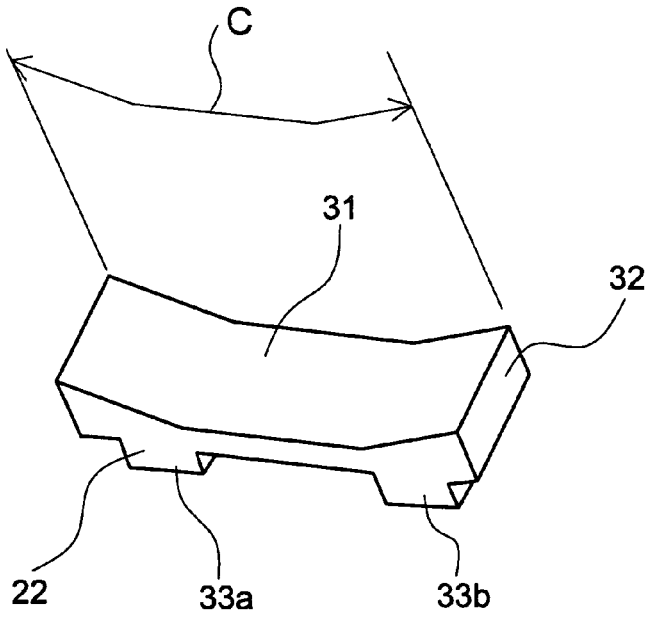
FIG. 5 is a squint-eyed diagram showing a shape of underside of a spacer in embodiment 1 of the present invention.
Figure 6:
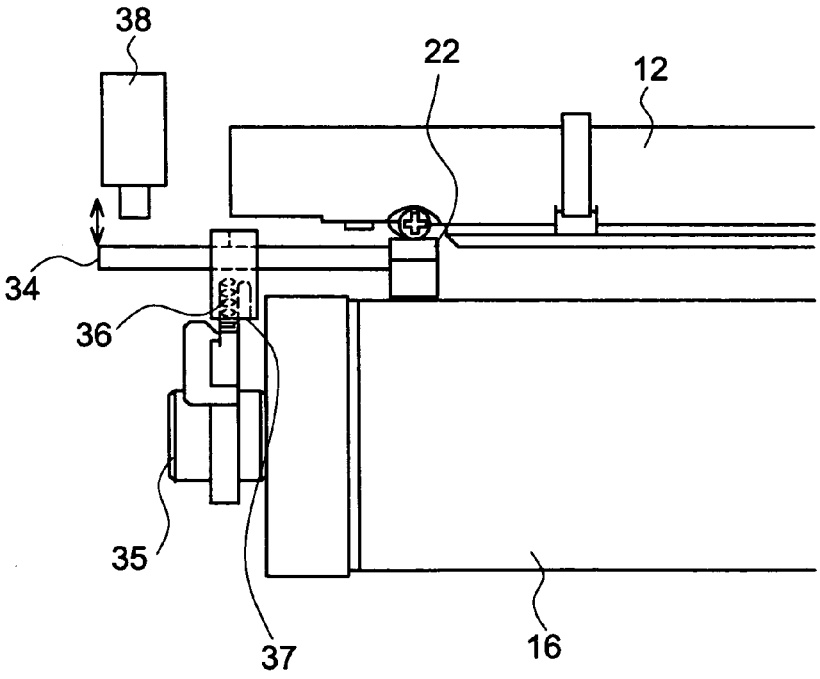
FIG. 6 is a front view diagram showing a spacer furnished in between a LED head and a photosensitive drum in embodiment 1 of the present invention.
Figure 7:
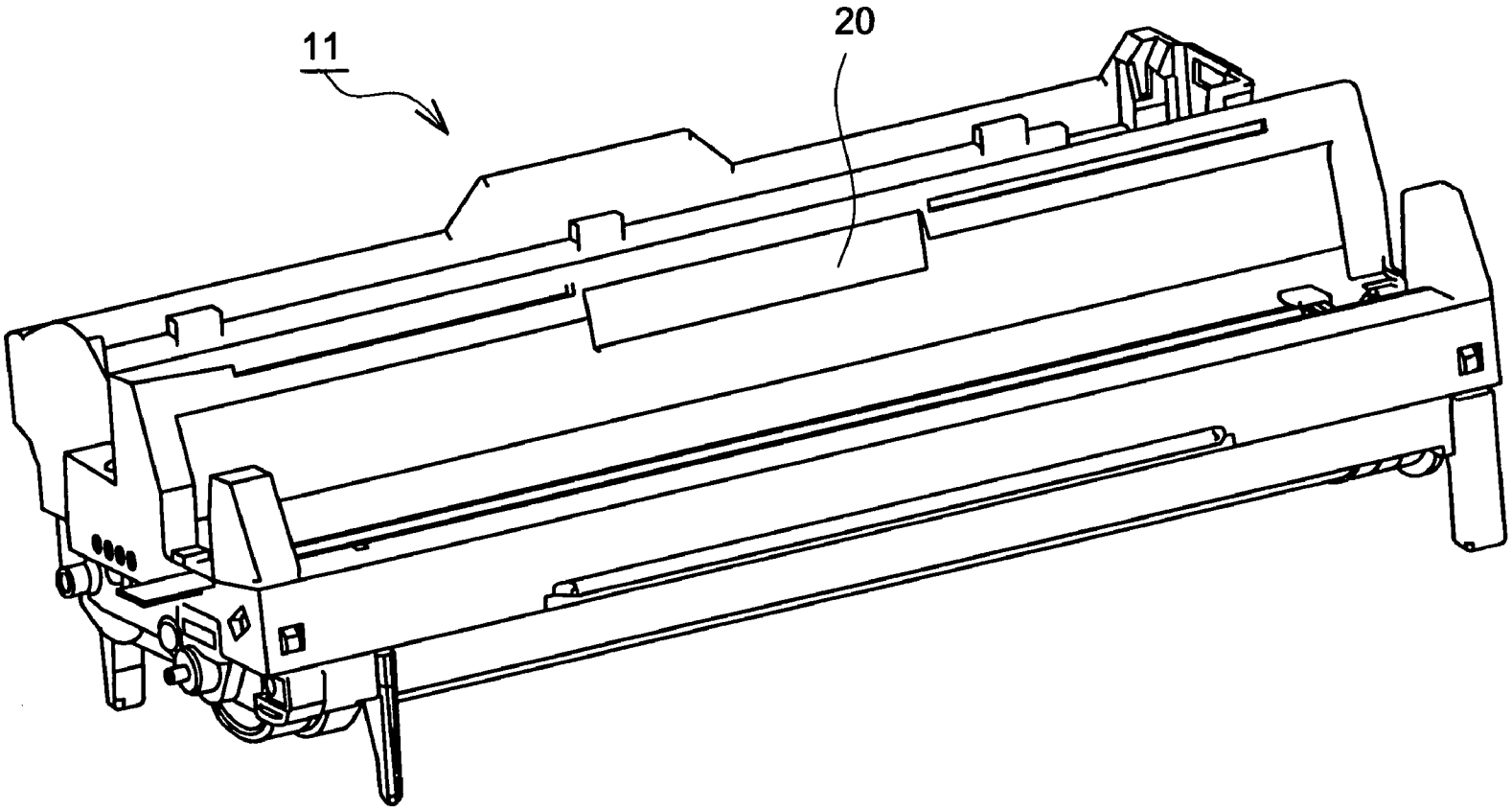
FIG. 7 is a squint-eyed diagram showing an ID (Image Drum cartridge) on which a cover is installed in embodiment 1 of the present invention.
Figure 8:
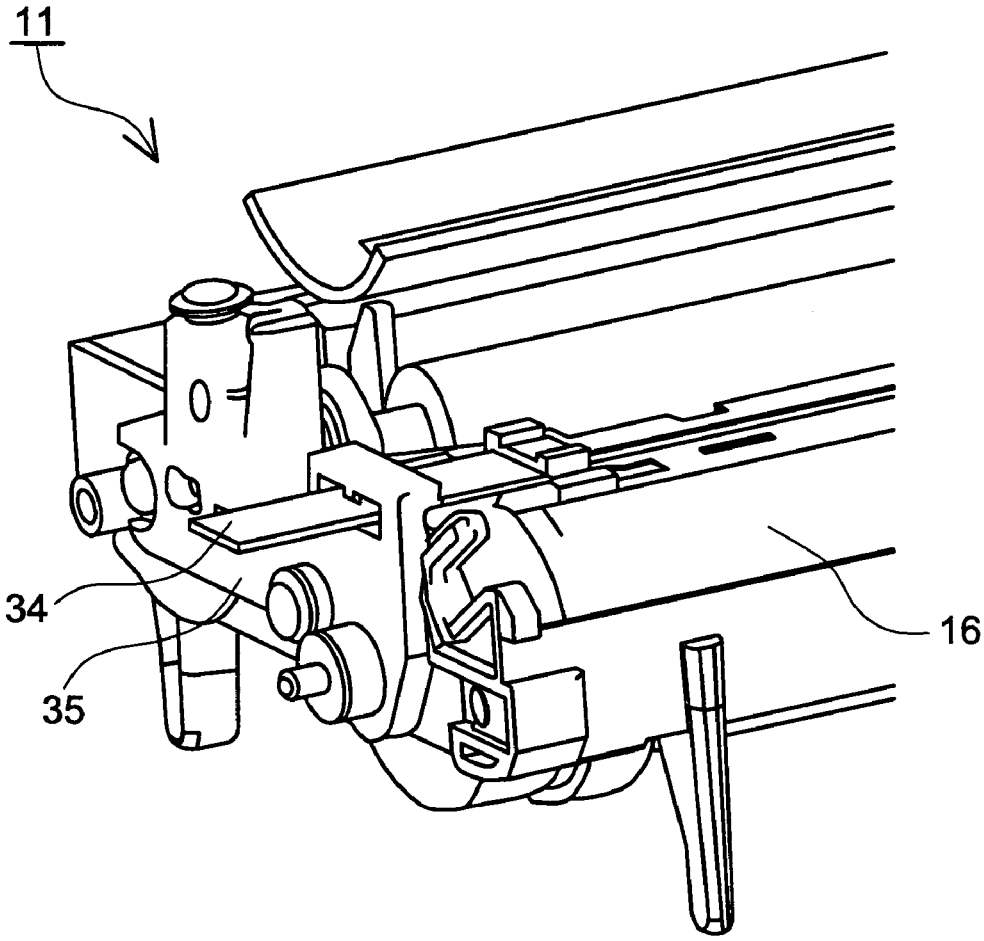
FIG. 8 is a squint-eyed diagram showing a main part of an ID in which a cover is removed in embodiment 1 of the present invention.
Figure 9:
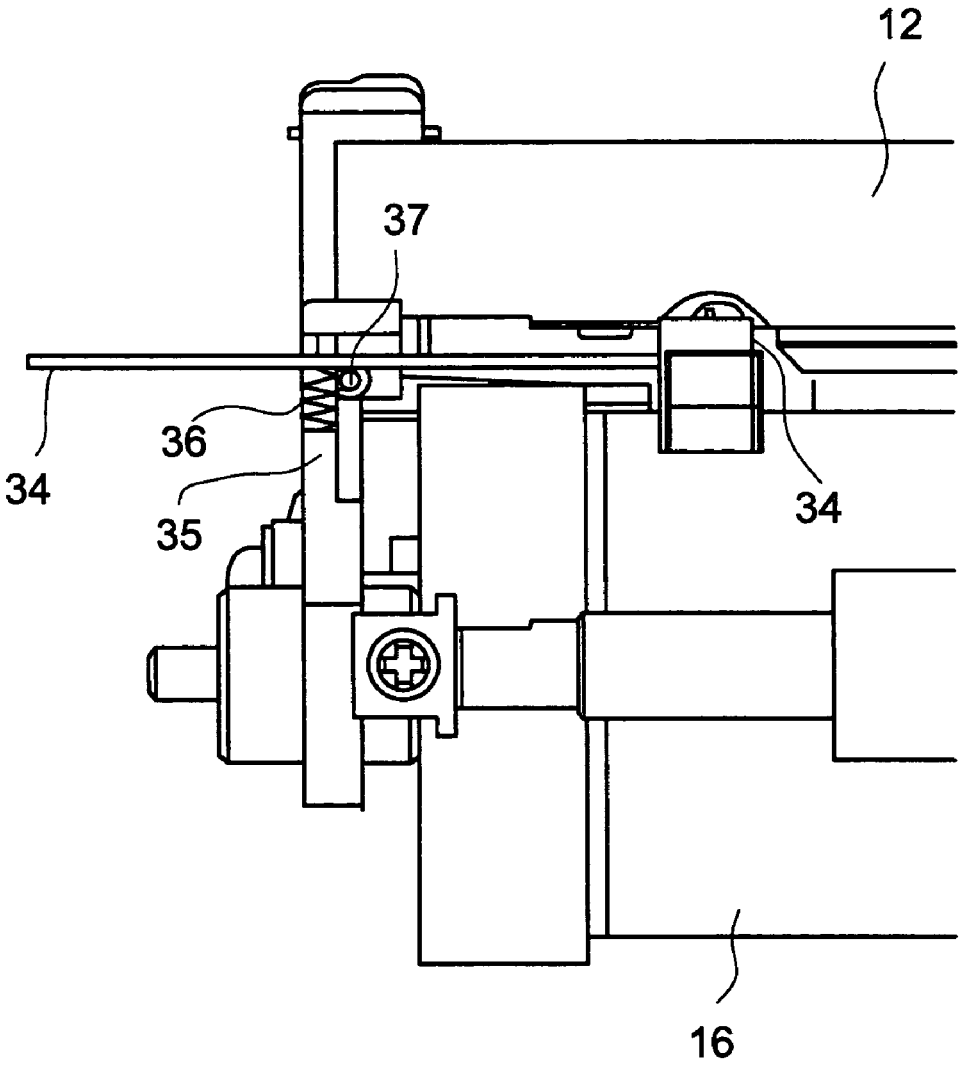
FIG. 9 is a front view diagram showing a main part of an ID in which a cover is removed in embodiment 1 of the present invention.
Figure 10:
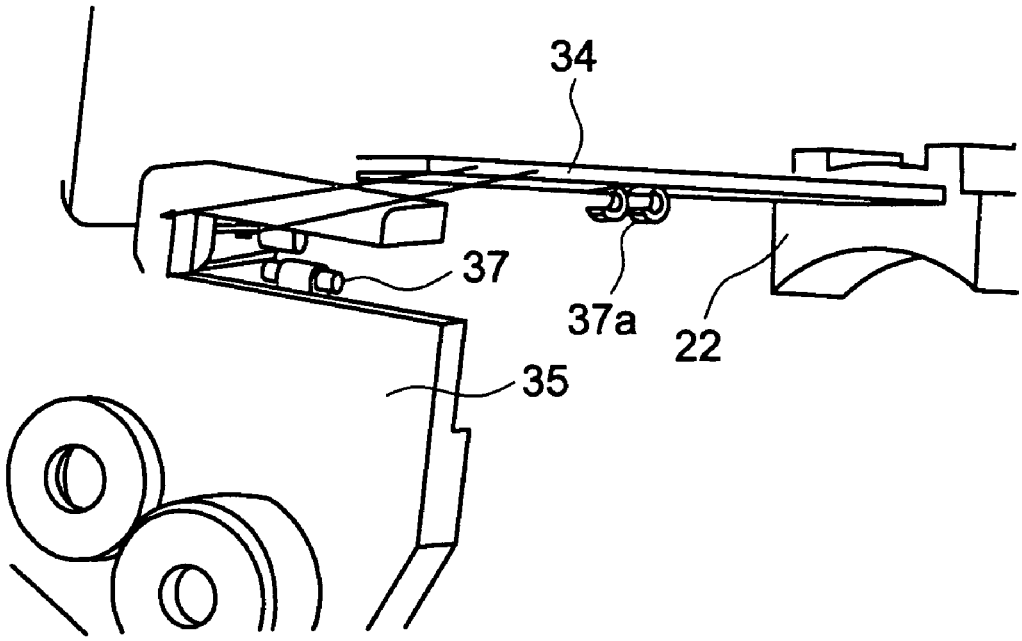
FIG. 10 is a diagram showing a state installing a lever in embodiment 1 of the present invention.
Figure 11:
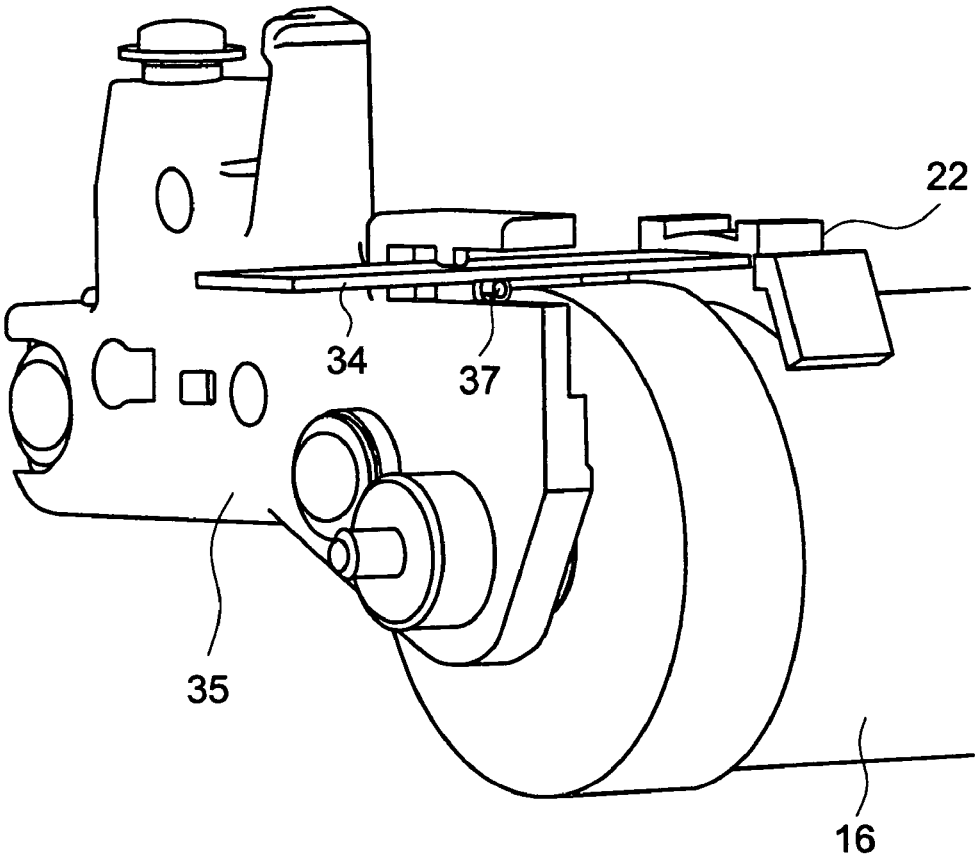
FIG. 11 is a squint-eyed diagram showing a main part of an ID on which a lever is installed in embodiment 1 of the present invention.

FIG. 1 is a squint-eyed diagram showing a spacer furnished in between a LED head and a photosensitive drum in embodiment 1 of the present invention; FIG. 4 is a squint-eyed diagram showing a summary shape of a spacer in embodiment 1 of the present invention; FIG. 5 is a squint-eyed diagram showing a shape of underside of a spacer in embodiment 1 of the present invention; FIG. 6 is a front view diagram showing a spacer furnished in between a LED head and a photosensitive drum in embodiment 1 of the present invention; FIG. 7 is a squint-eyed diagram showing an ID (Image Drum cartridge) on which a cover is installed in embodiment 1 of the present invention; FIG. 8 is a squint-eyed diagram showing a main part of an ID in which a cover is removed in embodiment 1 of the present invention; FIG. 9 is a front view diagram showing a main part of an ID in which a cover is removed in embodiment 1 of the present invention; FIG. 10 is a diagram showing a state installing a lever in embodiment 1 of the present invention; and FIG. 11 is a squint-eyed diagram showing a main part of an ID on which a lever is installed in embodiment 1 of the present invention.

As shown by the FIGS. 4 and 5, the spacer 22 has a contact surface 31 contacting with the surface of the photosensitive drum 16. The contact surface 31 is desired to be a curvature surface as drawing an arc. Moreover, the contact surface 31 is not limited being a curvature surface, it may also be a surface with V-shape. Further, the spacer 22 has a contact surface 33*a* and a contact surface 33*b* on reverse side of the contact surface 31. Furthermore, the spacer 22 has an upstream side end portion 32 as an image carrying body rotation upstream side end portion which places at an upstream side in a rotation direction of the photosensitive drum 16. Moreover, FIG. 5 shows a state when viewing the spacer 22 from under side. And C is a length of the spacer 22 in the rotation direction of the photosensitive drum 16.

Then, the spacer 22, as shown by the FIGS. 1 and 6, is furnished between the surface of the photosensitive drum 16 and the LED head 12 to limit a distance between the surface of the photosensitive drum 16 and the LED head 12. In the case, the contact surface 31 contacts with the surface of the photosensitive drum 16, the contact surface 33*a* and the contact surface 33*b* contact with the LED head 12. Moreover, in the FIG. 1, an arrow B indicates a rotation direction of the photosensitive drum 16. Then, a transfer remainder toner 25 accumulates on the upstream side end portion 32 of the spacer 22.

Further, as shown by the FIGS. 7-9, a lever 34 whose one end is installed on the spacer 22, is furnished as extending in an axis direction of the photosensitive drum 16 and the LED head 12. The other end of the lever 34 is projecting toward the outside of an ID frame body 35. Here, the FIG. 7 shows the ID 11 of a state in which a cover 20 is installed, and the FIGS. 8 and 9 shows the ID 11 of a state in which a cover 20 is removed for simplifying explanation. Moreover, the lever 34 may be formed in a body with the spacer 22.

Then, as shown by the FIG. 6, the lever 34 is rotatably supported by a lever rotation fulcrum 37 which is installed in the ID frame body 35, and is pressed by a pressing member 36 which is installed in the ID frame body 35 toward a direction enabling the spacer 22 to contact with the photosensitive drum 16. In the case, as shown by the FIG. 10, the lever 34 includes a fitted portion 37*a* which is fitted on the lever rotation fulcrum 37. Through fitting the fitted portion 37*a* on the lever rotation fulcrum 37, as shown by the FIG. 11, the lever 34 is supported by the lever rotation fulcrum 37. Further, on the cover 20 of the substance body side of the ID 11, a solenoid 38 is installed. A rod of the solenoid 38, as shown by an arrow in the FIG. 6, expands and contracts to possibly make the other end of the lever 34 move downward, which is opposite to the one end on the spacer 22.

Next is to explain operation of the electrophotography printer 10 with the above structure.

First is to explain a summary of a print process of the electrophotography printer 10. In execution process of the electrophotography printer 10, there are a charging process, an exposing process, a developing process and a transferring process. These process are executed in sequence to perform a print onto a medium.

Firstly, in the charging process, the charging roller 17 is supplied a high voltage to uniformly afford negative charge to the surface of the photosensitive drum 16. Continuously, in the exposing process, the LED head 12, according to print data, selectively irradiates light energy to the surface of the photosensitive drum 16. Thus, on the surface of the photosensitive drum 16, the electric potential of the part irradiated by the light energy, that is the exposed part falls. Then, because the part un-exposed keeps in a negative high electric potential state, so on the surface of the photosensitive drum 16, a difference of surface potential happened. Therefore, on the whole surface of the photosensitive drum 16, an electrostatic latent image is formed. Then, with the rotation of the photosensitive drum 16, the electrostatic latent image moves to the position of the developing roller 18.

Continuously, the developing process is to make toner adhere to the electrostatic latent image and to develop the electrostatic latent image into a toner image. The toner is charging through friction between the developing roller 18 and the developing blade 21 and friction between the developing roller 18 and the providing roller 19, and through voltages that are respectively supplied to the developing roller 18, the developing blade 21 and the providing roller 19.

Then, the charging toner moves to the surface of the photosensitive drum 16 in an electric field produced by a difference between the potential of the developing roller 18 and the potential of the surface of the photosensitive drum 16 to form an image.

Continuously, the transferring process is to afford positive electric charge to the back face of the medium from the transferring unit 13. Then, the toner negatively charging on the surface of the photosensitive drum 16 is transferred to the medium by a coulomb force. Moreover, the transfer remainder toner 25 as toner which is not transferred to the medium in the transferring process, after shaved by the cleaning roller 23 from the surface of the photosensitive drum 16, is returned to the photosensitive drum 16 and is finally collected by the developing roller 18.

Next is to explain print operation of the electrophotography printer 10.

Figure 12:
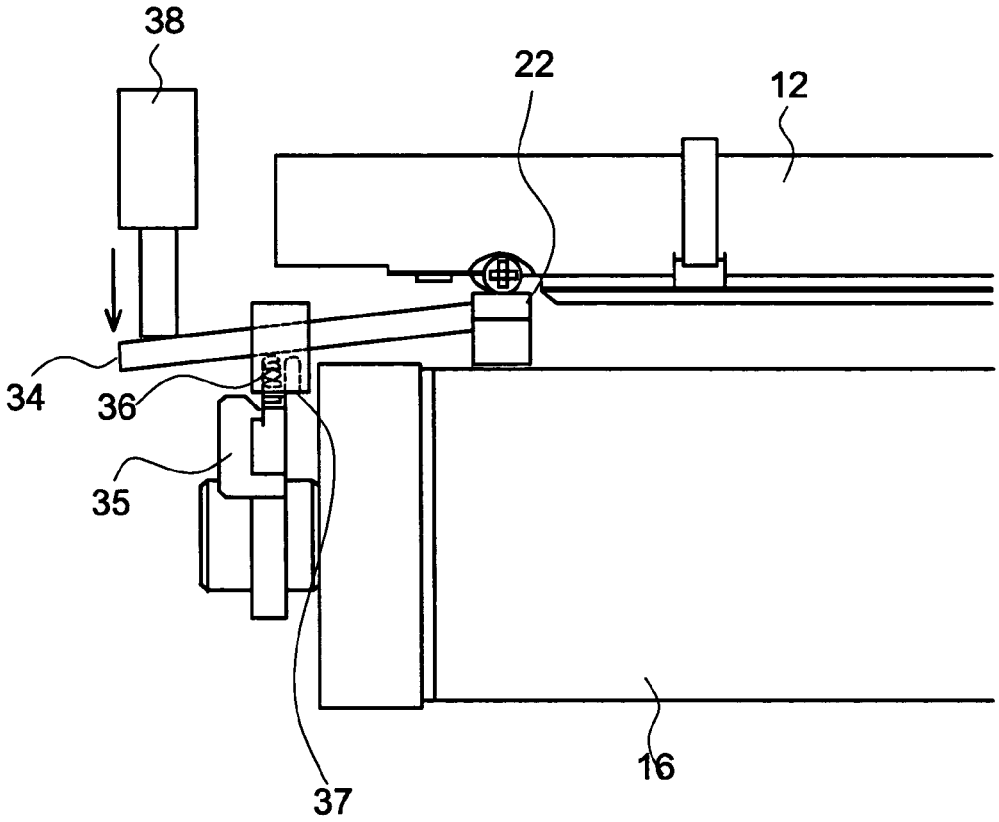
FIG. 12 is a front view diagram showing a state in which a spacer furnished in between a LED head and a photosensitive drum is lifted up in embodiment 1 of the present invention.
Figure 13:
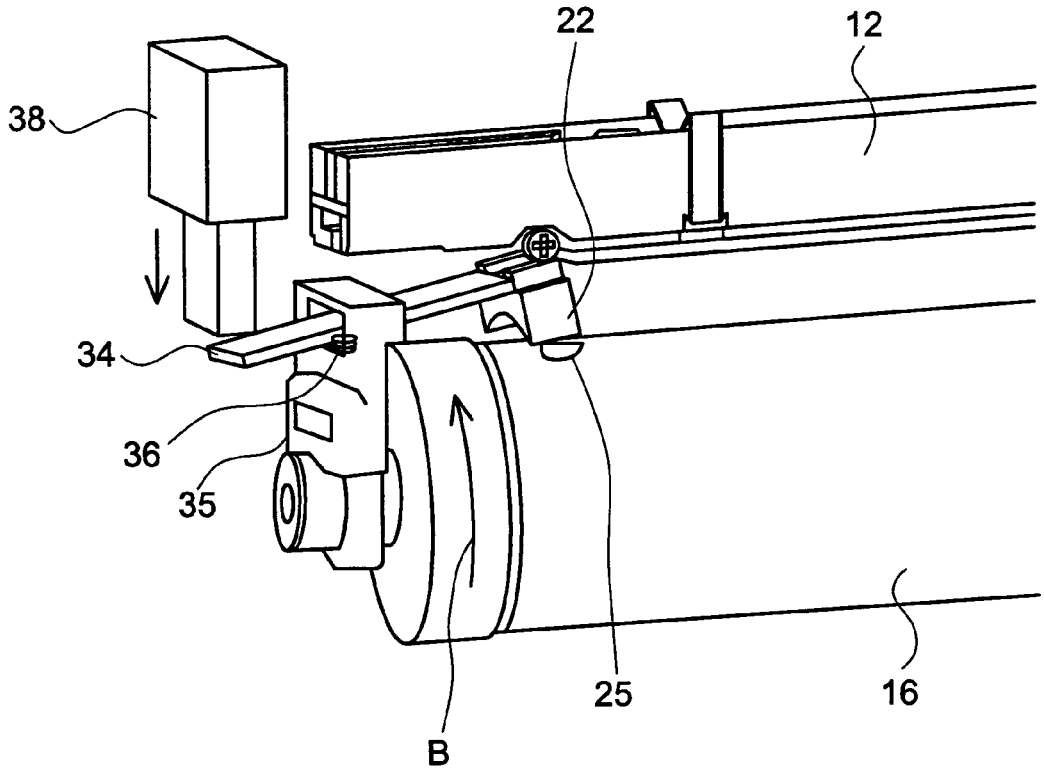
FIG. 13 is a squint-eyed diagram showing a state in which a spacer furnished in between a LED head and a photosensitive drum is lifted up in embodiment 1 of the present invention.
Figure 14:
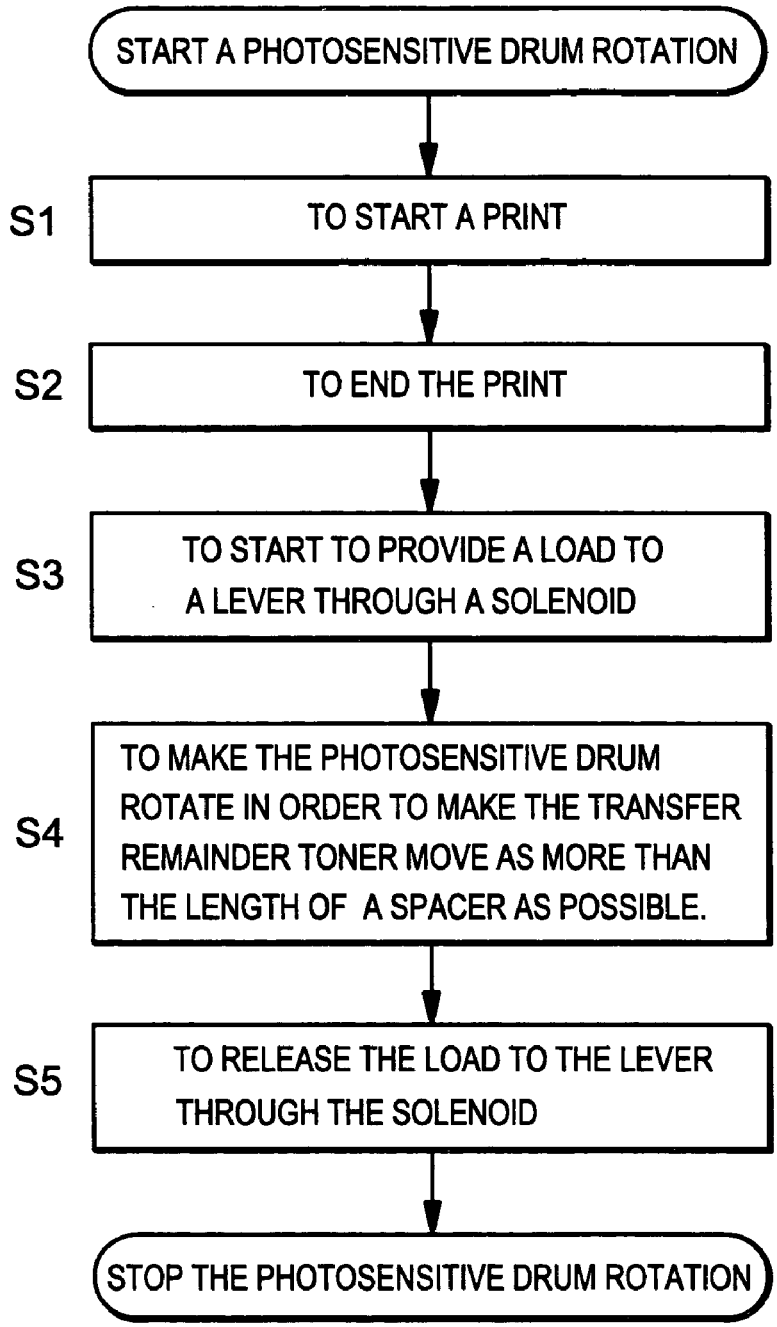
FIG. 14 is a flowchart showing print operation of a printer with electrophotography in embodiment 1 of the present invention.

FIG. 12 is a front view diagram showing a state in which a spacer furnished in between a LED head and a photosensitive drum is lifted up in embodiment 1 of the present invention; FIG. 13 is a squint-eyed diagram showing a state in which a spacer furnished in between a LED head and a photosensitive drum is lifted up in embodiment 1 of the present invention; and FIG. 14 is a flowchart showing print operation of a printer with electrophotography in embodiment 1 of the present invention.

Firstly, the electrophotography printer 10 starts to print after the photosensitive drum 16 rotates. Then, after a print ended, the solenoid 38 is operated. When the rod of the solenoid 38 expands to provide a load to the lever 34, as shown by the FIG. 12, the other end of the lever 34 moves downward, which is opposite to the one end on the spacer 22 side and is pressed downward by the rod of the solenoid 38. Thus, the spacer 22 is lifted up together with the LED head 12. Then, the spacer 22 and the surface of the photosensitive drum 16 become a separation state, so the transfer remainder toner 25 accumulated on the upstream side end portion 32 of the spacer 22 is left on the photosensitive drum 16.

Here, if the transfer remainder toner 25 is kept in such state just like that it is accumulated on the upstream side end portion 32 of the spacer 22, as explained in the related background art, the transfer remainder toner 25 gets a friction heat due to the rotation of the photosensitive drum 16. When got the friction heat exceeding a glass transfer point, the transfer remainder toner 25 liquefies; when the photosensitive drum 16 stops to rotate, the transfer remainder toner 25 is cooled to coagulate, and adheres to the upstream side end portion 32 of the spacer 22. In such state, when the photosensitive drum 16 rotates, the transfer remainder toner 25 adhering to the upstream side end portion 32 of the spacer 22 scrapes the surface of the photosensitive drum 16. Then, if the scrape of the surface of the photosensitive drum 16 arrives in the basic layer with electroconductivity, the voltage provided from the charging roller 17 occurs leak, then the normal charging process can not be executed, and a bad print is caused.

However, in the embodiment of the present invention, before the transfer remainder toner 25 accumulated on the upstream side end portion 32 of the spacer 22 adheres to the upstream side end portion 32 of the spacer 22, because the spacer 22 is lifted up, the transfer remainder toner 25 is left on the photosensitive drum 16 moves toward the downstream side of the rotation direction of the photosensitive drum 16 together with the surface of the photosensitive drum 16. Then, when the surface of the photosensitive drum 16 long rotates longer than the length C of the spacer 22 in the rotation direction of the photosensitive drum 16, the transfer remainder toner 25 moves to a downstream side lower than a downstream side end portion of the spacer 22 in the rotation direction of the photosensitive drum 16.

Continuously, the load provided by the lever 34 is released through the solenoid 38. Then, through the pressing force of the pressing member 36, the lever 34 clockwise rotates around the lever rotation fulcrum 37 as a center to return to the original position. Therefore, the spacer 22 moves downward together with the LED head 12 to contact with the surface of the photosensitive drum 16. At that time, on the surface of the photosensitive drum 16, the transfer remainder toner 25 does not exist on the part that is contacting with the spacer 22. Then the rotation of the photosensitive drum 16 is stopped.

Moreover, the supply of the load to the lever 34 through the solenoid 38 may not be performed per print, for example, it can be performed after executing print of plural sheets. Further, the supply of the load to the lever 34 through the solenoid 38 may not be performed after print, for example, it can be performed when print is not executed but the photosensitive drum 16 is rotating for warming up executed after plugging in the electrophotography printer 10 or when a printer cover is shut from an opening state or the like.

Next is to explain the flowchart.

Step S1: to start a print.

Step S2: to end the print.

Step S3: to start to provide a load to the lever 34 through the solenoid 38.

Step S4: to make the photosensitive drum 16 rotate in order to make the transfer remainder toner 25 move as more than the length of the spacer 22 as possible.

Step S5: to release the load to the lever 34 through the solenoid 38 and to end the process.

As stated above, the embodiment makes spacer 22 separate from a contact state with the surface of the photosensitive drum 16, and makes the transfer remainder toner 25 accumulated on the upstream side end portion 32 of the spacer 22 moves. Thus, because the transfer remainder toner 25 does not adhere to the upstream side end portion 32 of the spacer 22, it is eliminated that the surface of the photosensitive drum 16 is scraped. Therefore, it is possible to execute a normal charging process, and to prevent a bad print from happening.

Embodiment 2

Next is to explain an embodiment 2 of the present invention. Moreover, regarding the same element as that in the embodiment 1, it will be granted a same sign, and its explanation will be omitted. Further, the same operation and the same effect as that in the embodiment 1 will also be omitted.

Figure 15:
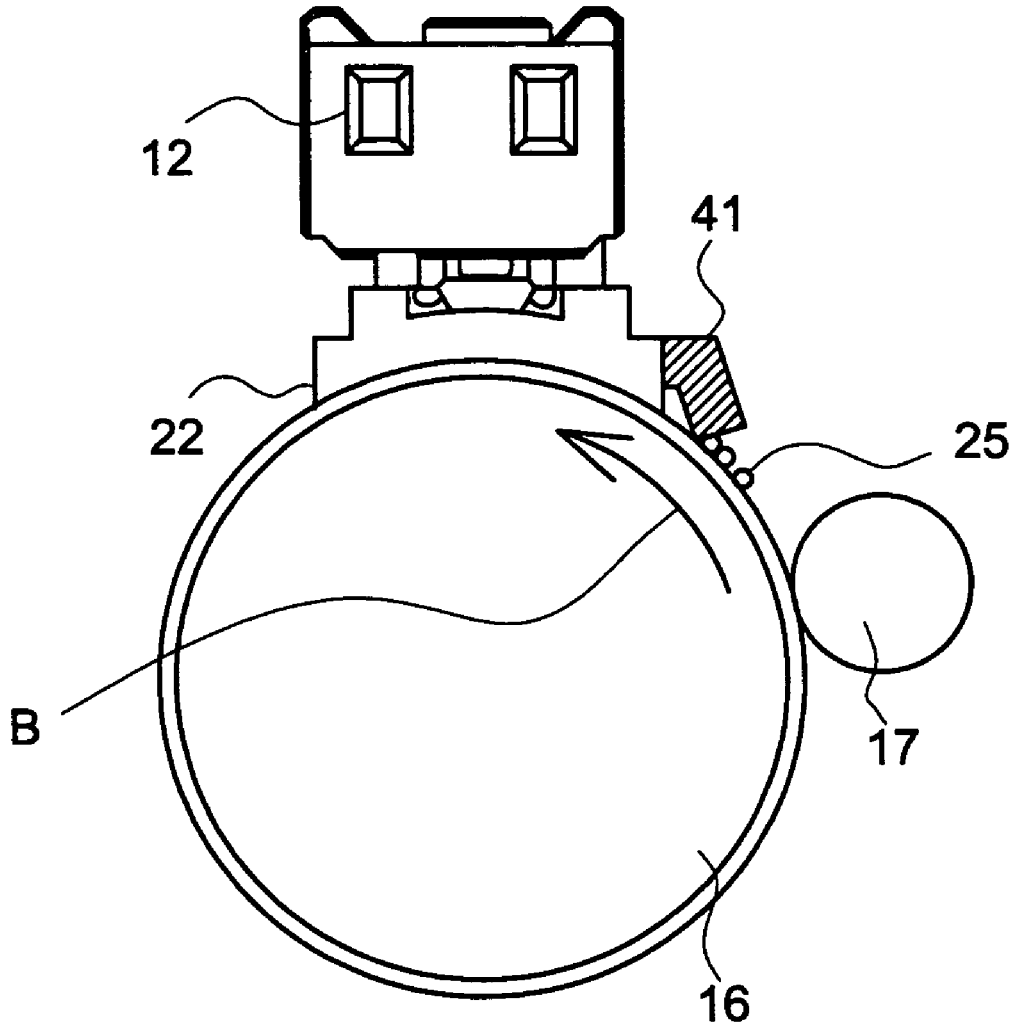
FIG. 15 is a diagram showing a spacer and a cleaning blade furnished in between a LED head and a photosensitive drum is lifted up in embodiment 2 of the present invention.
Figure 16:
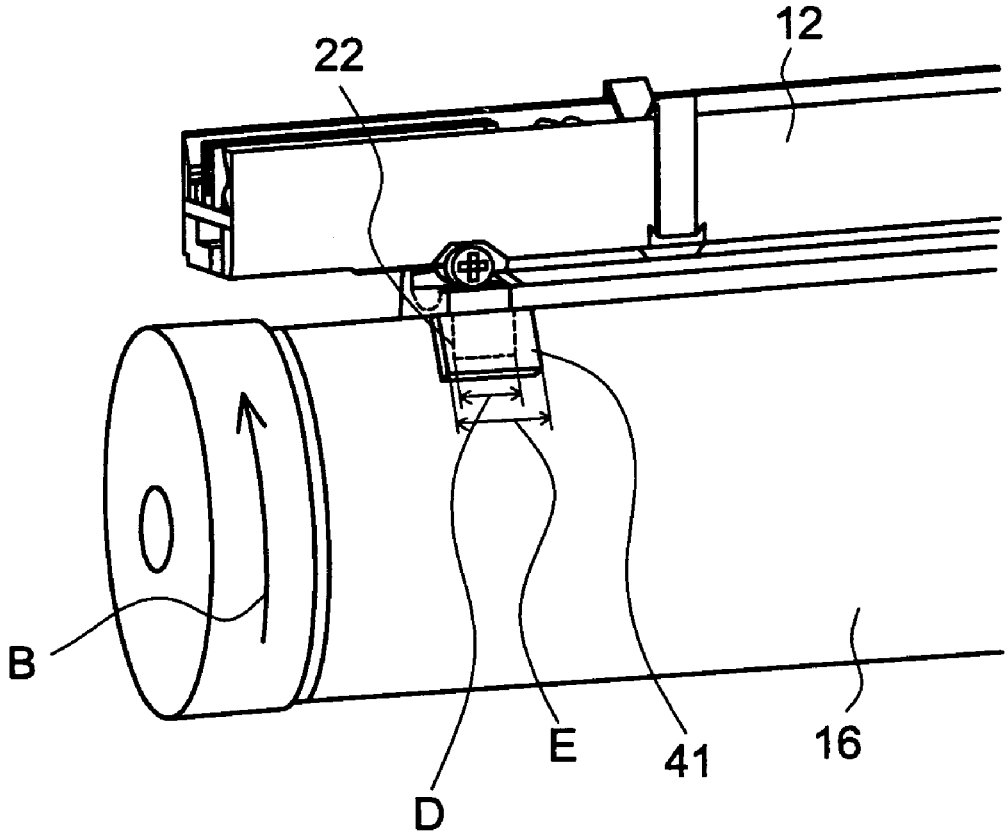
FIG. 16 is a first squint-eyed diagram showing a spacer and a cleaning blade furnished in between a LED head and a photosensitive drum is lifted up in embodiment 2 of the present invention.

FIG. 15 is a diagram showing a spacer and a cleaning blade furnished in between a LED head and a photosensitive drum is lifted up in embodiment 2 of the present invention; FIG. 16 is a first squint-eyed diagram showing a spacer and a cleaning blade furnished in between a LED head and a photosensitive drum is lifted up in embodiment 2 of the present invention; and FIG. 17 is a second squint-eyed diagram showing a spacer and a cleaning blade furnished in between a LED head and a photosensitive drum is lifted up in embodiment 2 of the present invention.

As shown by the FIG. 15, In the present invention, on the upstream side of the spacer 22 in the rotation of the photosensitive drum 16, a cleaning blade 41 is furnished as a cleaning member made of Urethane gom. The cleaning blade 41 is pressed to contact with the surface of the photosensitive drum 16. Then, as shown by the FIG. 16, a width E of the cleaning blade 41 in an axis direction of the photosensitive drum 16 is formed as being wider than a width D of the spacer 22. The material of the cleaning blade 41 may be any one kind if only possibly shaving the transfer remainder toner 25, for example, it may be made from Urethane sponge, Teflon felt or the like. Moreover, the cleaning blade 41 may be formed in one body with the spacer 22 through a fixation means, the fixation means may be to perform a fixation using adhesiveness, also may be to perform a heat weld.

Further, the furnished position of the cleaning blade 41 is at upstream side of the spacer 22 in the rotation direction of the photosensitive drum 16, it may be anywhere if only being at downstream side of the charging roller 17 in the rotation direction of the photosensitive drum 16, further it may be apart from the spacer 22. In the embodiment, the cleaning blade 41 is installed on the spacer 22, it may also be installed in the inside of the unit 11.

Figure 17:
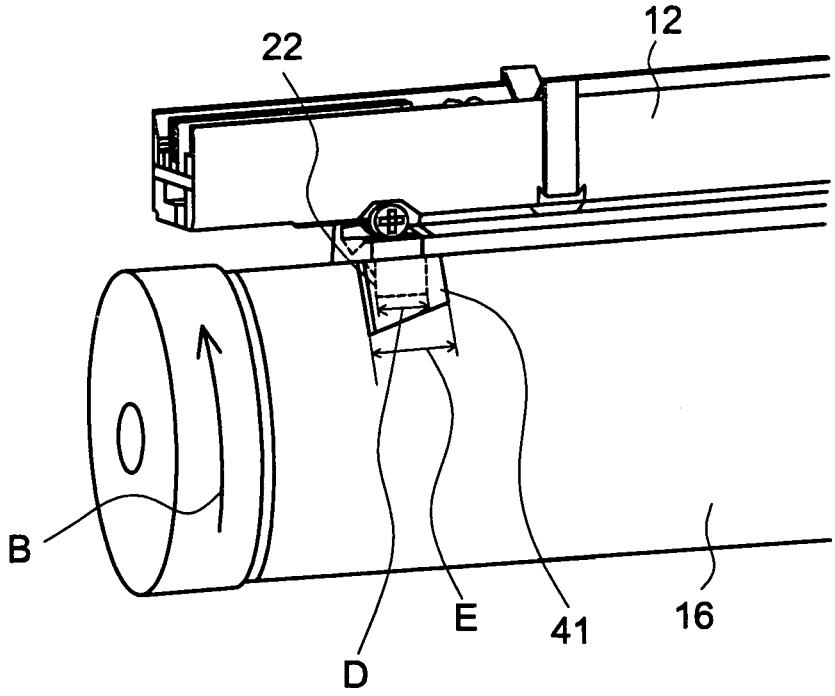
FIG. 17 is a second squint-eyed diagram showing a spacer and a cleaning blade furnished in between a LED head and a photosensitive drum is lifted up in embodiment 2 of the present invention.

Furthermore, a cleaning blade 42 also can be used with a shape shown by the FIG. 17. The cleaning blade 42 is formed as that the part pressed and contacted to the surface of the photosensitive drum 16 inclines with respect to the axis direction of the photosensitive drum 16. That is, in the cleaning blade 42, if the width E in the axis direction of the photosensitive drum 16 is wider than the width D of the spacer 22, the part pressed and contacted to the surface of the photosensitive drum 16 may incline with respect to the axis direction of the photosensitive drum 16. Moreover, the inclination direction may be toward the inside of the ID 11 from the outside; also may be toward the outside of the ID 11 from the inside. However, in the case that the inclination direction is toward the outside, the toner maybe move to out of an area of the cleaning roller 23, then the toner is not cleaned. Therefore, it is desired that the inclination direction is toward the inside. Thus, the toner which is made move to the inside is easily cleaned by the cleaning roller 23.

Next is to explain operation of the electrophotography printer 10 in this embodiment.

Firstly, the photosensitive drum 16 rotates along a direction indicated by an arrow B. When the transfer remainder toner on the surface of the photosensitive drum 16 arrived at the cleaning blade 41, the transfer remainder toner 25 is stopped by the cleaning blade 41. Here, because the width E of the cleaning blade 41 in the axis direction of the photosensitive drum 16 is wider than the width D of the spacer 22, the transfer remainder toner 25 at least does not arrive in a range of the width D of the spacer 22. Therefore, the transfer remainder toner 25 does not accumulate on the upstream side end portion 32 of the spacer 22. Further, because a contact point of the cleaning blade 41 and the photosensitive drum 16 is perpendicularly closer to the upstream side of the rotation direction of the photosensitive drum 16 than a contact point of the spacer 22 and the photosensitive drum 16, the toner easily falls downward without accumulating.

Thus, in the embodiment, the cleaning blade 41 shaves the transfer remainder toner 25 on the surface of the photosensitive drum 16. Because the transfer remainder toner 25 does not arrive at the spacer 22, so the transfer remainder toner 25 does not accumulate on the upstream side end portion 32 of the spacer 22. Therefore, because the transfer remainder toner 25 does not adhere to the upstream side end portion 32 of the spacer 22, it is eliminated that the surface of the photosensitive drum 16 is scraped, and it is possible to execute a normal charging process and to prevent a bad print from happening.

Further, because a machinery to make the spacer 22 contact with and separate from the surface of the photosensitive drum 16 is left out, it is possible to improve the assembling ability of the ID 11, and to reduce the parts number of the ID 11.

Moreover, through combining the contact and separation machinery with the cleaning member, it is possible to prevent the toner from accommodating on a shaving portion of the cleaning member.

Embodiment 3

Next is to explain an embodiment 3 of the present invention. Moreover, regarding the same element as that in the embodiments 1 and 2, it will be granted a same sign, and its explanation will be omitted. Further, the same operation and the same effect as that in the embodiments 1 and 2 will also be omitted.

Figure 18:
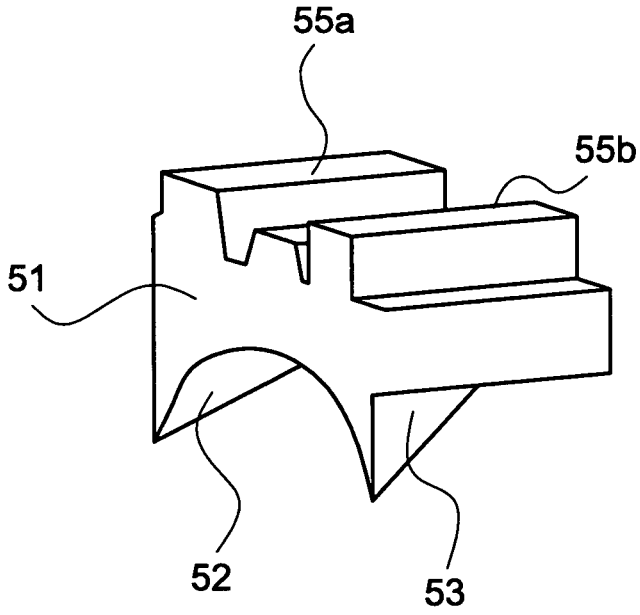
FIG. 18 is a squint-eyed diagram showing a summary shape of a spacer in embodiment 3 of the present invention.
Figure 19:
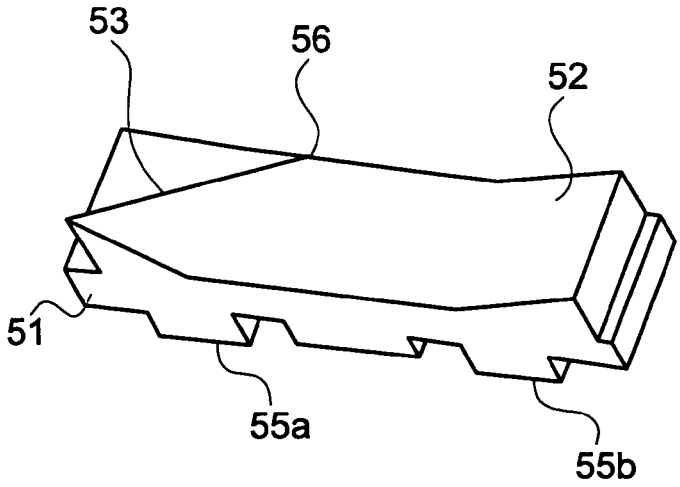
FIG. 19 is a squint-eyed diagram showing a underside shape of a spacer in embodiment 3 of the present invention.
Figure 20:
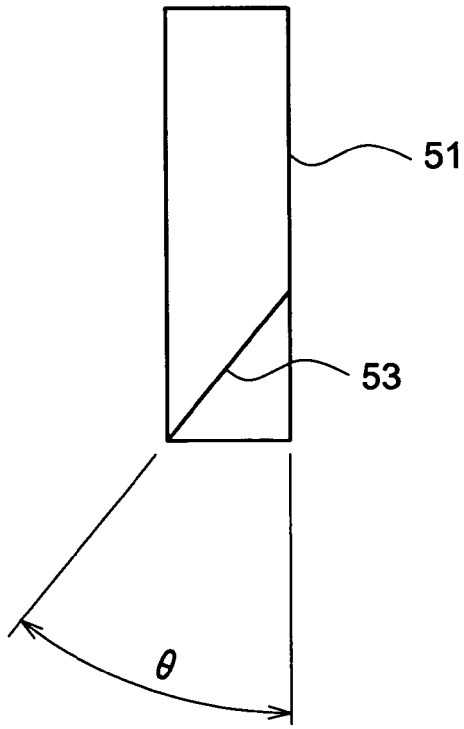
FIG. 20 is a diagram showing an incline angle of an upstream side end portion in embodiment 3 of the present invention.
Figure 21:
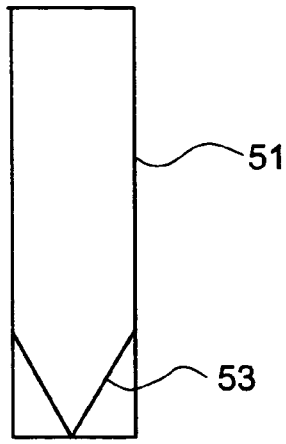
FIG. 21 is a diagram showing an incline direction of an upstream side end portion in embodiment 3 of the present invention.

FIG. 18 is a squint-eyed diagram showing a summary shape of a spacer in embodiment 3 of the present invention; FIG. 19 is a squint-eyed diagram showing a underside shape of a spacer in embodiment 3 of the present invention; FIG. 20 is a diagram showing an incline angle of an upstream side end portion in embodiment 3 of the present invention; and FIG. 21 is a diagram showing an incline direction of an upstream side end portion in embodiment 3 of the present invention.

In the embodiment, a spacer 51 as a distance limiting member, as shown by the FIG. 18, has a contact surface 52 contacting with the surface of the photosensitive drum 16. The contact surface 52 is desired to be a curvature surface as drawing an arc. Moreover, the contact surface 52 is not limited being a curvature surface, it may also be a surface with V-shape. Further, the spacer 51 has a contact surface **55*a* and a contact surface 55*b* on reverse side of the contact surface 52. Furthermore, the spacer 51 has an upstream side end portion 53 as an image carrying body rotation upstream side end portion which places at an upstream side in a rotation direction of the photosensitive drum 16**.

FIG. 19 shows a state when viewing the spacer 51 from under side. As shown by the FIG. 19, the upstream side end portion 53 inclines toward the inside of the ID 11 from the outside with respect to the rotation direction of the photosensitive drum 16. Then, the spacer 51 is furnished as that a downstream end portion 56 in the upstream side end portion 53 in the rotation direction of the photosensitive drum 16 places at the outside of the ID 11 out of a printable medium with a maximum width.

Further, as shown by the FIG. 20, an inclination angle θ of the upstream side end portion 53 is desired to be less than 60 degrees so as to make the transfer remainder toner 25 can smoothly move along the upstream side end portion 53. Moreover, the upstream side end portion 53, with respect to the rotation direction of the photosensitive drum 16, may be formed as inclining toward the outside of the ID 11 from the inside of the ID 11; and also may be formed as inclining toward two directions as shown by the FIG. 21.

However, in the case that the inclination direction is toward the outside, the toner maybe move to out of an area of the cleaning roller 23, then the toner is not cleaned. Therefore, it is desired that the inclination direction is toward the inside. Thus, the toner made move to the inside is easily cleaned by the cleaning roller 23.

Next is to explain operation of the electrophotography printer 10 in the embodiment.

Figure 22:
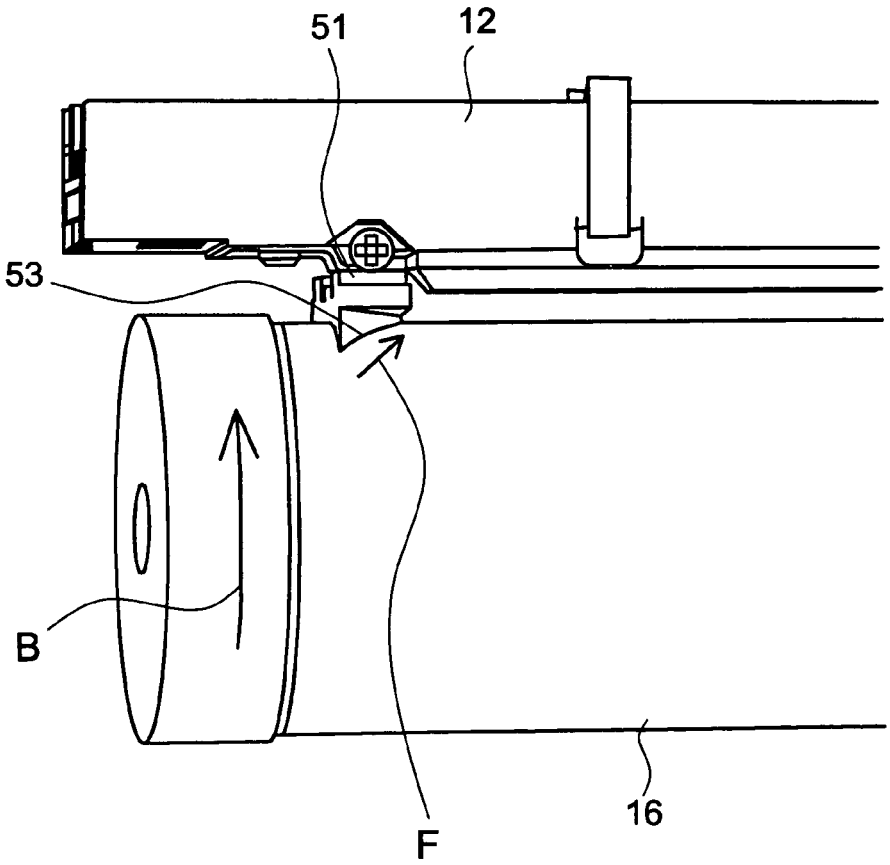
FIG. 22 is a squint-eyed diagram showing a spacer furnished in between a LED head and a photosensitive drum in embodiment 3 of the present invention.
Figure 23:
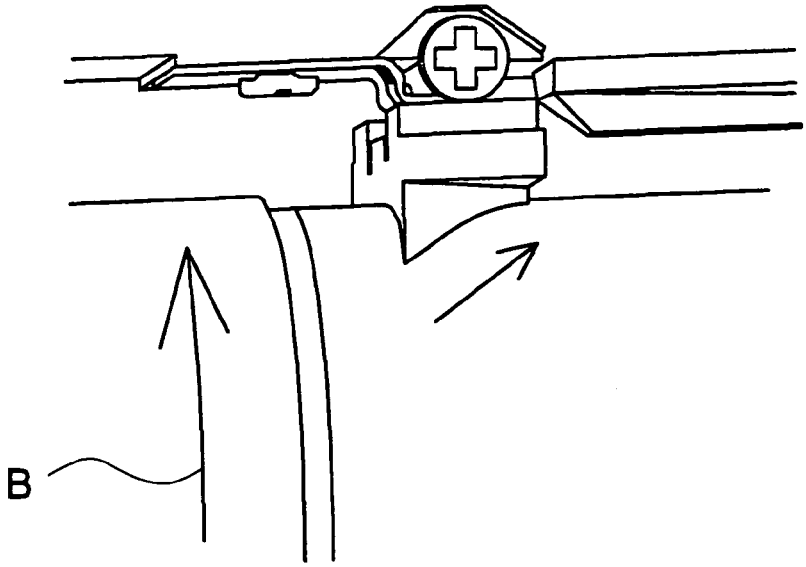
FIG. 23 is a magnification diagram showing a main part of a spacer furnished in between a LED head and a photosensitive drum in embodiment 3 of the present invention.

FIG. 22 is a squint-eyed diagram showing a spacer furnished in between a LED head and a photosensitive drum in embodiment 3 of the present invention; and FIG. 23 is a magnification diagram showing a main part of a spacer furnished in between a LED head and a photosensitive drum in embodiment 3 of the present invention.

As shown by the FIG. 22, after the photosensitive drum 16 rotates along a direction indicated by an arrow B and the transfer remainder toner 25 arrived at the upstream side end portion 53 of the spacer 51, the transfer remainder toner 25, along the inclining upstream side end portion 53, as indicated by an arrow F, moves to the downstream side of the rotation direction of the photosensitive drum 16 from the outside of the ID 11 to the inside of the ID 11. At that time, because the transfer remainder toner 25 is not scraped by the upstream side end portion 53 of the spacer 51, so the transfer remainder toner 25 does not accumulate on the upstream side end portion 53 of the spacer 51.

As stated above, in the embodiment, the transfer remainder toner 25 on the photosensitive drum 16, even if arrived at the upstream side end portion 53 of the spacer 51, because moving along the inclining upstream side end portion 53, so does not accumulate on the upstream side end portion 53. Thus, because the transfer remainder toner 25 does not adhere to the upstream side end portion 53 of the spacer 51, it is eliminated that the surface of the photosensitive drum 16 is scraped, and it is possible to execute a normal charging process and to prevent a bad print from happening. Further, because a machinery to make the spacer 51 contact with and separate from the surface of the photosensitive drum 16 and the cleaning blade 41 are left out, it is possible to improve the assembling ability of the ID 11, and to reduce the parts number of the ID 11.

Moreover, through combining the contact and separation machinery with an inclination shape, it is possible to prevent the toner from accommodating on an inclination portion.

Embodiment 4

Next is to explain an embodiment 4 of the present invention. Moreover, regarding the same element as that in the embodiments 1, 2 and 3, it will be granted a same sign, and its explanation will be omitted. Further, the same operation and the same effect as that in the embodiments 1, 2 and 3 will also be omitted.

Figure 24:
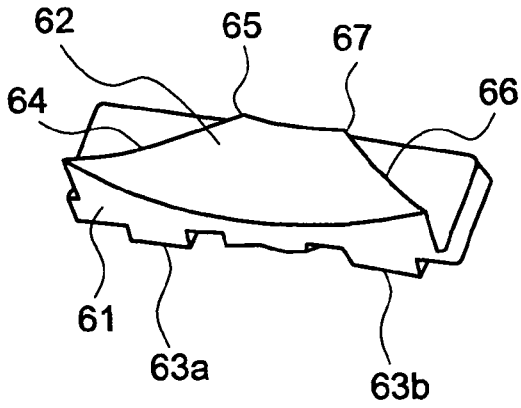
FIG. 24 is a squint-eyed diagram showing an underside shape of a spacer in embodiment 4 of the present invention.
Figure 25:
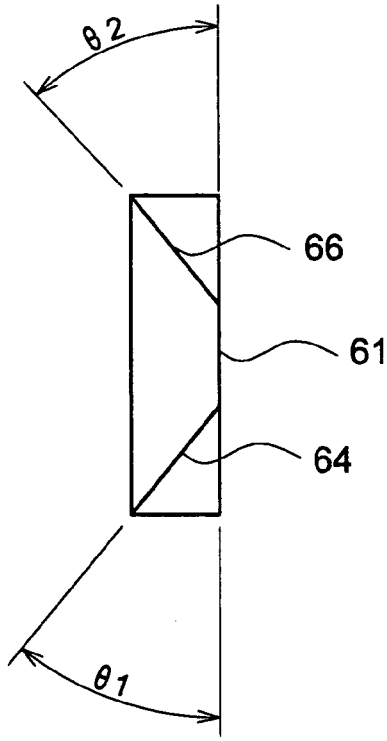
FIG. 25 is a diagram showing an incline angle of an upstream side end portion and a downstream side end portion in embodiment 4 of the present invention.
Figure 26A:
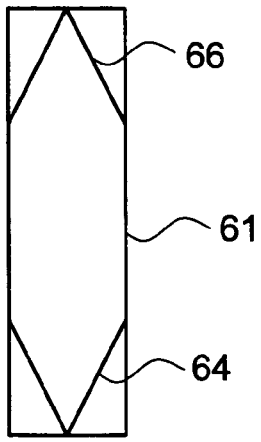
FIG. 26A is a first diagram showing an incline direction of an upstream side end portion and a downstream side end portion in embodiment 4 of the present invention.
Figure 26B:
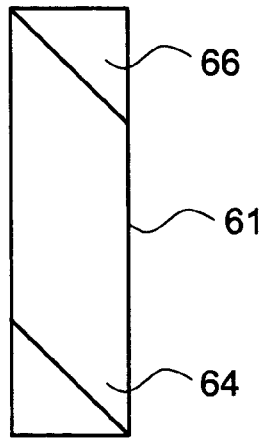
FIG. 26B is a second diagram showing an incline direction of an upstream side end portion and a downstream side end portion in embodiment 4 of the present invention.
Figure 27:
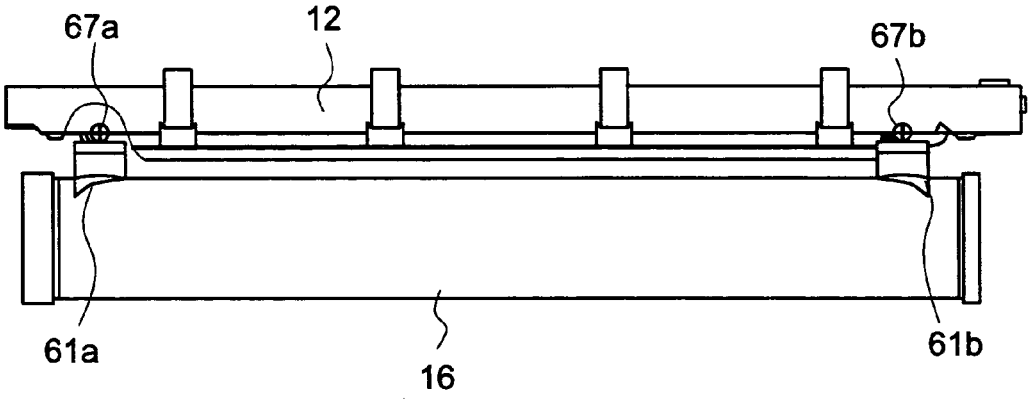
FIG. 27 is a diagram showing a method to mount a spacer in embodiment 4 of the present invention.

FIG. 24 is a squint-eyed diagram showing an underside shape of a spacer in embodiment 4 of the present invention; FIG. 25 is a diagram showing an incline angle of an upstream side end portion and a downstream side end portion in embodiment 4 of the present invention; FIG. 26A is a first diagram showing an incline direction of an upstream side end portion and a downstream side end portion in embodiment 4 of the present invention; FIG. 26B is a second diagram showing an incline direction of an upstream side end portion and a downstream side end portion in embodiment 4 of the present invention and FIG. 27 is a diagram showing a method to mount a spacer in embodiment 4 of the present invention.

In the embodiment, a spacer 61 as a distance limiting member, as shown by the FIG. 24, has a contact surface 62 contacting with the surface of the photosensitive drum 16. The contact surface 62 is desired to be a curvature surface as drawing an arc. Moreover, the contact surface 62 is not limited being a curvature surface, it may also be a surface with V-shape. Further, the spacer 61 has a contact surface 63*a* and a contact surface 63*b* on reverse side of the contact surface 62. Furthermore, the spacer 61 has an upstream side end portion 64 as an image carrying body rotation upstream side end portion which places at an upstream side in a rotation direction of the photosensitive drum 16, and a downstream side end portion 66 as an image carrying body rotation downstream side end portion which places at a downstream side in a rotation direction of the photosensitive drum 16.

Then, the upstream side end portion 64 inclines toward the inside of the ID 11 from the outside of the ID 11 with respect to the rotation direction of the photosensitive drum 16. Then, the spacer 61 is furnished as that a downstream end portion 65 in the upstream side end portion 64 in the rotation direction of the photosensitive drum 16 places at the outside of the ID 11 out of a printable medium with a maximum width.

Further, as shown by the FIG. 25, an inclination angle θ1 of the upstream side end portion 64 is desired to be less than 60 degrees so as to make the transfer remainder toner 25 can smoothly move along the upstream side end portion 64. Moreover, the upstream side end portion 64, with respect to the rotation direction of the photosensitive drum 16, may be formed as inclining toward the outside of the ID 11 from the inside of the ID 11; also may be formed as inclining toward two directions as shown by the FIG. 26A; and also may be formed as inclining toward one direction as shown by the FIG. 26B.

Then, the upstream side end portion 66 inclines toward the outside of the ID 11 from the inside of the ID 11 with respect to the rotation direction of the photosensitive drum 16. Then, the spacer 61 is furnished as that an upstream end portion 67 in the downstream side end portion 66 in the rotation direction of the photosensitive drum 16 places at the outside of the ID 11 out of a printable medium with a maximum width.

Further, as shown by the FIG. 25, an inclination angle θ2 of the downstream side end portion 66 is desired to be less than 60 degrees so as to make the transfer remainder toner 25 can smoothly move along the downstream side end portion 66. Moreover, the downstream side end portion 66, with respect to the rotation direction of the photosensitive drum 16, may be formed as inclining toward the inside of the ID 11 from the outside of the ID 11; also may be formed as inclining toward two directions as shown by the FIG. 26.

Then, the spacer 61, as shown by the FIG. 27, is respectively furnished on the two ends of the photosensitive drum 16. Moreover, the spacer 61 of left side serves as a left side spacer 61*a*, and the spacer 61 of right side serves as a right side spacer 61*b*. in the case, spacer contact portions 67*a* and 67*b* of left and right of the LED head 12 are different. Further, the left side spacer 61*a* and the right side spacer 61*b* are installed as they are opposite each other.

Next is to explain operation of the electrophotography printer 10 in the embodiment.

Figure 28A:
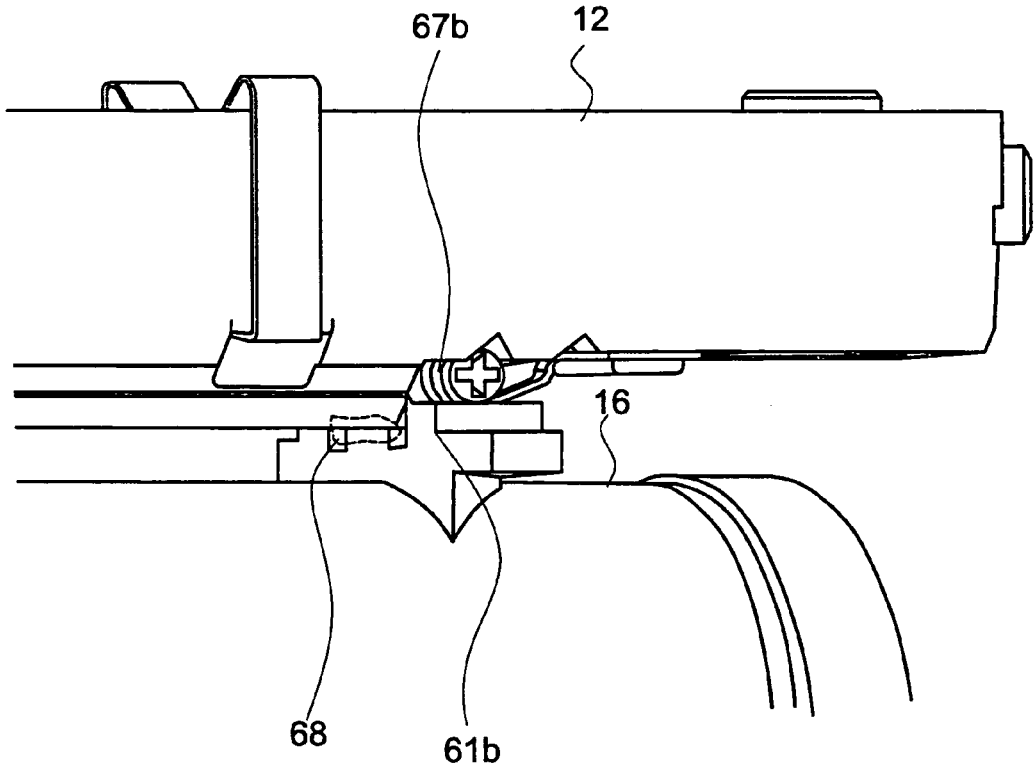
FIG. 28A is a main part magnification squint-eyed diagram showing an interference of a spacer and a LED head in embodiment 4 of the present invention.
Figure 28B:
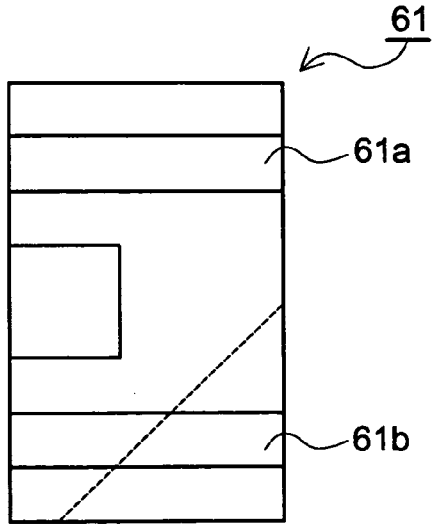
FIG. 28B is an upside diagram of spacer showing an interference of a spacer and a LED head in embodiment 4 of the present invention.
Figure 29:
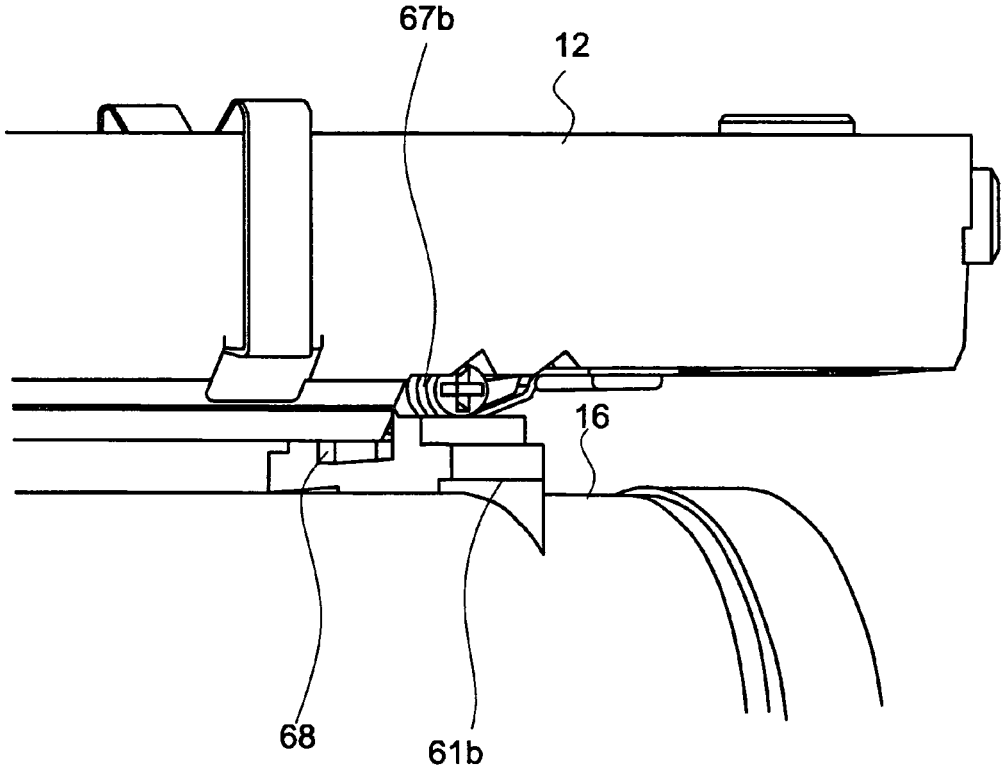
FIG. 29 is a diagram showing a state in which an interference of a spacer and a LED head is cancelled in embodiment 4 of the present invention.

FIG. 28 is a diagram showing an interference of a spacer and a LED head in embodiment 4 of the present invention; and FIG. 29 is a diagram showing a state in which an interference of a spacer and a LED head is cancelled in embodiment 4 of the present invention. Moreover, FIG. 28A is a main part magnification squint-eyed diagram; and FIG. 28B is an upside diagram of spacer.

In the embodiment, the spacer contact portion 67*a* of left side of the LED head 12 contacts with the left side spacer 61*a*, but because the spacer contact portion 67*b* of right side of the LED head 12 is different from the spacer contact portion 67*a*, if installing the right side spacer 61*b* in a same direction as the left side spacer 61*a*, as shown by the FIG. 28, an interference happened in an interference portion 68. Therefore, as shown by the FIG. 29, the right side spacer 61*b* is furnished through changing its direction so as to release the interference. Thus, the spacer contact portion 67*b* of right and the right side spacer 61*b* contact each other without interfering.

In the case, on the one hand, because the direction of the right side spacer 61*b* is changed, the downstream side end portion 66 of the right side spacer 61*b* becomes to place at an upstream side in the rotation direction of the photosensitive drum 16. Because of this, after the photosensitive drum 16 rotates and the transfer remainder toner 25 on the photosensitive drum 16 arrived at the downstream side end portion 66 of the spacer 61*b*, the transfer remainder toner 25, along the inclining downstream side end portion 66, moves to the downstream side of the rotation direction of the photosensitive drum 16 from the outside of the ID 11 to the inside of the ID 11. At that time, because the transfer remainder toner 25 is not scraped by the downstream side end portion 66 of the spacer 61*b*, so the transfer remainder toner 25 does not accumulate on the downstream side end portion 66 of the spacer 61*b*.

On the other hand, in the left side spacer 61*a*, the upstream side end portion 64 of the right side spacer 61*a* places at an upstream side in the rotation direction of the photosensitive drum 16. Because of this, after the photosensitive drum 16 rotates and the transfer remainder toner 25 arrived at the upstream side end portion 64 of the spacer 61*a*, the transfer remainder toner 25, along the inclining upstream side end portion 64, as indicated by an arrow F, moves to the downstream side of the rotation direction of the photosensitive drum 16 from the outside of the ID 11 to the inside of the ID 11. At that time, because the transfer remainder toner 25 is not scraped by the upstream side end portion 64 of the spacer 61*a*, so the transfer remainder toner 25 does not accumulate on the upstream side end portion 64 of the spacer 61*a*.

As stated above, in the embodiment, the transfer remainder toner 25 on the photosensitive drum 16, even if arrived at the upstream side end portion 64 of the left side spacer 61*a*, because moving along the inclining upstream side end portion 64, so does not accumulate on the upstream side end portion 64. Thus, because the transfer remainder toner 25 does not adhere to the upstream side end portion 64 of the left side spacer 61*a*, it is eliminated that the surface of the photosensitive drum 16 is scraped.

Further, the transfer remainder toner 25 on the photosensitive drum 16, even if arrived at the downstream side end portion 66 of the right side spacer 61*b*, because moving along the inclining downstream side end portion 66, so does not accumulate on the downstream side end portion 66. Thus, because the transfer remainder toner 25 does not adhere to the downstream side end portion 66 of the right side spacer 61*b*, it is eliminated that the surface of the photosensitive drum 16 is scraped.

Therefore, it is possible to execute a normal charging process and to prevent a bad print from happening. Further, because a machinery to make the spacer 51 contact with and separate from the surface of the photosensitive drum 16 and the cleaning blade 41 are left out, it is possible to improve the assembling ability of the ID 11, and to reduce the parts number of the ID 11. Furthermore, even if the spacer contact portion 67*a* and the spacer contact portion 67*b* of left and right of the LED head 12 are different, because possibly only using a kind of spacer 61, it is easy to manage parts.

Moreover, in the embodiments 1-4 of the present invention, an example applied to the electrophotography printer is explained, but it also can be applied to other apparatus such as MFP (compound type printer: Multiple Function Printer), facsimile apparatus, copying apparatus and the like.

The present invention is not limited to the foregoing embodiments but many modifications and variations are possible within the spirit and scope of the appended claims of the invention.

What is claimed is:

1. An image forming unit, comprising:

an image carrying body exposed by an exposing unit; and a distance limiting member to limit a distance between the exposing unit and the image carrying body, wherein said distance limiting member extends in a rotation direction of the image carrying body and has an upstream side end portion in the rotation direction of the image carrying body, and the upstream side end portion has a shape whose width is widening toward downstream side, and wherein said distance limiting member further includes a surface opposite to the image carrying body, and a sharp edge is formed at an intersection between the upstream side end portion and said surface opposite to the image carrying body, and wherein the sharp edge inclines with respect to the rotation direction of the image carrying body with an inclination angle less than or equal to 60 degrees.

2. The image forming unit according to claim 1, wherein said upstream side end portion has an inclination formed toward the inside of said image carrying body.

3. The image forming unit according to claim 2, wherein said inside is a center portion of said image carrying body in a length direction.

4. The image forming unit according to claim 1, wherein said distance limiting member has a downstream side end portion in the rotation direction of the image carrying body, the downstream side end portion having an inclination with respect to the rotation direction of the image carrying body.

5. The image forming unit according to claim 1, wherein said surface of the distance limiting member opposite to the image carrying body is a curved surface corresponding to a surface of the image carrying body.

6. The image forming unit according to claim 1, wherein the distance limiting member contacts the image carrying body in at least two portions.

7. An image forming apparatus comprising:

an image forming unit, wherein said image forming unit has an image carrying body exposed by an exposing unit, and a distance limiting member to limit a distance between the exposing unit and the image carrying body, and wherein said distance limiting member extends in a rotation direction of the image carrying body and has an upstream side end portion in the rotation direction of the image carrying body, and the upstream side end portion has a shape whose width is widening toward downstream side, and wherein said distance limiting member further includes a surface opposite to the image carrying body, and a sharp edge is formed at an intersection between the upstream side end portion and said surface opposite to the image carrying body, and wherein the sharp edge inclines with respect to the rotation direction of the image carrying body with an inclination angle less than or equal to 60 degrees.

8. The image forming apparatus according to claim 7, wherein said upstream side end portion has an inclination formed toward the inside of said image carrying body.

9. The image forming apparatus according to claim 8, wherein said inside is a center portion of said image carrying body in a length direction.

10. The image forming apparatus according to claim 7, wherein said distance limiting member has a downstream side end portion in the rotation direction of the image carrying body, the downstream side end portion having an inclination with respect to the rotation direction of the image carrying body.

11. The image forming apparatus according to claim 7, wherein a surface of the distance limiting member opposite to the image carrying body is a curved surface corresponding to a surface of the image carrying body.

12. The image forming apparatus according to claim 7, wherein the distance limiting member contacts the image carrying body in at least two portions.

13. An image forming unit, comprising:

an image carrying body exposed by an exposing unit; and a distance limiting member to limit a distance between the exposing unit and the image carrying body, wherein said distance limiting member has an upstream side surface in a rotation direction of the image carrying body and a bottom surface opposite to the image carrying body, the upstream side surface has a shape whose width is widening toward downstream side, and a sharp edge is formed at an intersection between the upstream side surface and the bottom surface, and wherein the sharp edge inclines with respect to the rotation direction of the image carrying body with an inclination angle less than or equal to 60 degrees.

14. An image forming apparatus comprising:

an image forming unit, wherein said image forming unit has an image carrying body exposed by an exposing unit; and a distance limiting member to limit a distance between the exposing unit and the image carrying body, and wherein said distance limiting member has an upstream side surface in a rotation direction of the image carrying body and a bottom surface opposite to the image carrying body, the upstream side surface has a shape whose width is widening toward downstream side, and a sharp edge is formed at an intersection between the upstream side surface and the bottom surface, and wherein the sharp edge inclines with respect to the rotation direction of the image carrying body with an inclination angle less than or equal to 60 degrees.

* * * * *